US005260510A

United States Patent [19]

Shibukawa

[11] Patent Number: 5,260,510

[45] Date of Patent: Nov. 9, 1993

[54] AUTOMATIC ACCOMPANIMENT APPARATUS FOR DETERMINING A NEW CHORD TYPE AND ROOT NOTE BASED ON DATA OF A PREVIOUS PERFORMANCE OPERATION

[75] Inventor: Takeo Shibukawa, Hamamatsu, Japan

[73] Assignee: Yamaha Corporation, Hamamatsu, Japan

[21] Appl. No.: 843,421

[22] Filed: Feb. 27, 1992

[30] Foreign Application Priority Data

Mar. 1, 1991 [JP] Japan ..... 3-036428

[51] Int. Cl.[5] ..... G10H 1/38

[52] U.S. Cl. ..... 84/637; 84/DIG. 22

[58] Field of Search ..... 84/613, 637, DIG. 22

[56] References Cited

U.S. PATENT DOCUMENTS 4,300,430 11/1981 Bione et al. ..... 84/DIG. 22

FOREIGN PATENT DOCUMENTS 58-171092 10/1983 Japan .

*Primary Examiner*—Stanley J. Witkowski

*Attorney, Agent, or Firm*—Spensley Horn Jubas & Lubitz

[57] ABSTRACT

An automatic accompaniment apparatus for an electronic musical instrument comprises a performance data generating device, a key-count detection device, a chord data memory, a chord data decision device and an accompaniment performing device. The performance data generating device generates key depression data and tone pitch data in response to a performance operation. The key-count detection device detects a count of depressed keys in the performance operation based on said key depression data, and generates data representing the count of depressed keys. The chord data memory stores previous chord data representing a chord type and a root note, and the previous chord data corresponds to a performance operation played previously. The chord data decision device detects a chord pattern corresponding to said count of depressed keys and said tone pitch data and, when said count of depressed key corresponds to a specific count, decides chord data based on said chord pattern and said previous chord data. The accompaniment performing device performs an accompaniment based on said decided chord data.

2 Claims, 14 Drawing Sheets

| i | CHORD NAME \ DEGREE \ BIT | 0 | 1 | 2 | 3 | 4 | 5 | 6 | 7 | 8 | 9 | 10 | 11 | CHORD | |
|---|---|---|---|---|---|---|---|---|---|---|---|---|---|---|---|
| | | 1 | 1# | 2 | 2# | 3 | 4 | 4# | 5 | 5# | 6 | 6# | 7 | ROOT NOTE RT | CHORD TYPE TP |
| 0 | Maj | 1 | 0 | 0 | 0 | 1 | 0 | 0 | 1 | 0 | 0 | 0 | 0 | RRT | 0 |
| 1 | m | 1 | 0 | 0 | 1 | 0 | 0 | 0 | 1 | 0 | 0 | 0 | 0 | RRT | 1 |
| 2 | 7th | 1 | 0 | 0 | 0 | 1 | 0 | 0 | 1 | 0 | 0 | 1 | 0 | RRT | 2 |
| 3 | M7th | 1 | 0 | 0 | 0 | 1 | 0 | 0 | 1 | 0 | 0 | 0 | 1 | RRT | 3 |
| 4 | 6th(m7th) | 1 | 0 | 0 | 0 | 1 | 0 | 0 | 1 | 0 | 1 | 0 | 0 | RRT<br>(RRT+1)<br>mod 12 | 4<br>18 |
| 5 | mM7th | 1 | 0 | 0 | 1 | 0 | 0 | 0 | 1 | 0 | 0 | 0 | 1 | RRT | 5 |
| 6 | m6th(m7th-5) | 1 | 0 | 0 | 1 | 0 | 0 | 0 | 1 | 0 | 1 | 0 | 0 | RRT<br>(RRT+1)<br>mod12 | 6<br>11 |
| 7 | M-5 | 1 | 0 | 0 | 0 | 1 | 0 | 1 | 0 | 0 | 0 | 0 | 0 | RRT | 7 |
| 8 | 7th-5 | 1 | 0 | 0 | 0 | 1 | 0 | 1 | 0 | 0 | 0 | 1 | 0 | RRT(RRT +6)mod12 | 8 |
| 9 | M7th-5 | 1 | 0 | 0 | 0 | 1 | 0 | 1 | 0 | 0 | 0 | 0 | 1 | RRT | 9 |
| 10 | m-5 | 1 | 0 | 0 | 1 | 0 | 0 | 1 | 0 | 0 | 0 | 0 | 0 | RRT | 10 |
| 11 | dim=m6th-5 | 1 | 0 | 0 | 1 | 0 | 0 | 1 | 0 | 0 | 1 | 0 | 0 | LWNT | 11 |
| 12 | mM7-5 | 1 | 0 | 0 | 1 | 0 | 0 | 1 | 0 | 0 | 0 | 0 | 1 | RRT | 12 |
| 13 | M+5=aug | 1 | 0 | 0 | 0 | 1 | 0 | 0 | 0 | 1 | 0 | 0 | 0 | LWNT | 13 |
| 14 | 7th+5 | 1 | 0 | 0 | 0 | 1 | 0 | 0 | 0 | 1 | 0 | 1 | 0 | RRT | 14 |
| 15 | M7th+5 | 1 | 0 | 0 | 0 | 1 | 0 | 0 | 0 | 1 | 0 | 0 | 1 | RRT | 15 |
| 16 | sus4<br>(inharmonic4) | 1 | 0 | 0 | 0 | 0 | 1 | 0 | 1 | 0 | 0 | 0 | 0 | RRT<br>LWNT | 16<br>20 |
| 17 | 7thsus4 | 1 | 0 | 0 | 0 | 0 | 1 | 0 | 1 | 0 | 0 | 1 | 0 | RRT | 17 |
| 18 | inharmonic1 | 1 | 1 | 1 | 0 | 0 | 0 | 0 | 0 | 0 | 0 | 0 | 0 | LWNT | 21 |
| 19 | inharmonic2 | 1 | 1 | 0 | 1 | 0 | 0 | 0 | 0 | 0 | 0 | 0 | 0 | LWNT | 22 |
| 20 | inharmonic3 | 1 | 1 | 0 | 0 | 1 | 0 | 0 | 0 | 0 | 0 | 0 | 0 | LWNT | 23 |

FIG.5

RULES FOR FRACTIONAL CHORDS

| TWO KEYS DEPRESSED | PREVIOUSLY CHORD | FRACTIONAL CHORD |
|---|---|---|
| C+C# | | DbM7/C |
| C+D | Dm, Dm7<br>Dm7-5, DmM7-5<br>D7-5, DM7-5<br>OTHERS | Dm7/C<br>Dm7-5/C<br>D7-5/C<br>D/C |
| C+D# | Cm-5, Cm7-5, CmM7-5<br>OTHERS | Cm-5<br>Cm |
| C+E | C-5, C7-5, CM7-5, Cm-5, Cm7-5, CmM7-5<br>C+5, C7+5<br>OTHERS | C-5<br>C+5<br>CMaj |
| C+F | Fm, Fm6, Fm7, FmM7<br>Fm-5, Fm7-5, FmM7-5<br>F-5, F7-5, FM7-5<br>OTHERS | Fm/C<br>Fm7-5/C<br>F7-5/C<br>F/C |
| C+F# | C-5, C7-5, CM7-5<br>OTHERS | C-5<br>Cm-5 |
| C+G | Cm, Cm6, Cm7, CmM7, Cm-5, Cm7-5, CmM7-5<br>OTHERS | Cm<br>CMaj |
| C+G# | | Ab/C |
| C+A | Am-5, Am7-5, AmM7-5<br>OTHERS | Am<br>CMaj |
| C+A# | Cm, Cm7, CmM7<br>Cm-5, Cm7-5, CmM7-5, Ebm6, Cdim<br>C-5, C7-5, CM7-5, Gb7-5<br>OTHERS | Cm7<br>Cm7-5/C<br>C7-5/C<br>C7 |
| C+B | Cm7, CmM7<br>OTHERS | CmM7<br>CM7 |

FIG. 6

AUTOMATIC ACCOMPANIMENT APPARATUS FOR DETERMINING A NEW CHORD TYPE AND ROOT NOTE BASED ON DATA OF A PREVIOUS PERFORMANCE OPERATION

BACKGROUND OF THE INVENTION

This invention relates to an automatic accompaniment apparatus suitable for use in electronic musical instruments, such as electronic pianos.

BACKGROUND ART

Modern electronic musical instruments, such as electronic pianos, are often equipped with automatic accompaniment apparatus, which, so as to assist in chord performance and bass performance, detects the chord type and the root note of a chord performance by a player and, based on the detected results, generates chord tones and bass tones automatically, at a predetermined timing.

Such automatic accompaniment apparatus utilize various ways to detect the chord types and root notes. The rotation technique and the memory technique which are known as such detecting ways are explained below.

(1) The Rotation Technique

According to this technique, of the various chord types based on the twelve tones (consisting of C, C#, D . . . A#, B), those sharing a common root note are grouped and memorized in a corresponding chord pattern table in the form of 12-bit chord patterns (referred to as chord patterns). The keyboard is examined first to determine which key region (for example, the lower keys) is being used to play a chord. Depressed keys, identified according to the region, are taken into a register as a 12-bit depressed key bit pattern (referred to as a depressed key pattern). The content in this register is compared serially with the content of the memorized chord pattern table to determine the chord type of the played key. The comparison action involves a rotation of the content of the register, 1-bit at a time, against the content of the chord pattern table to identify the chord. The result is the identification of the root note with a number of pitch notation which corresponds to the number of rotations, and the chord type is determined by the corresponding chord pattern in the identified table. One of the problems with the rotation technique is that, for example, when a performer plays the keys in such a way as not to fully depress all of the keys (the partial type), this technique is unable to determine the corresponding chord types and the root notes. The memory technique, described next, was developed to overcome such deficiencies of the rotation technique.

(2) The Memory Technique

In this technique, the chord patterns having the same number (physical count) of keys are grouped and memorized in respective tables, and each table is identified with a count. During the performance, the condition of the depressed keys is taken into a register as a depressed key pattern and is compared with the table to determine the chord type and the root note corresponding to the depressed chord. By this technique, even if the performer does not fully depress all the keys, it is possible to determine its chord type and the root note. This type of techniques is disclosed in Japanese Patent Application Laid-open No.S58-171092.

However, such automatic accompaniment apparatus incorporating the musical memory technique is able to identify only the chord corresponding to the count of depressed keys, and is not able to reflect the interrelationship between the successive chords. In other words, the system is not structured to identify the chord pattern of the presently depressed keys in comparison with the chord pattern of the previously depressed keys, and therefore, the system is unable to accurately reflect the chord type and the root notes appropriate to the performance.

SUMMARY OF THE PRESENT INVENTION

The objective of the present invention is, therefore, to present an automatic accompaniment apparatus which enables chord tone to be reproduced simply and accurately in accordance with the style of the music playing.

Therefore, this invention presents an automatic accompaniment apparatus which comprises:

(a) performance data generating means for generating tone pitch data in response to a performance operation;

(b) key-count detection means for detecting a count of tone pitches designated by the tone pitch data, and for generating data representing the count of the tone pitches;

(c) chord data memory means for storing previous chord data representing a chord representing a chord type and a root note, the previous chord data corresponding to a performance operation played previously;

(d) chord data decision means for, when the count of the tone pitches does not correspond to a predetermined count, choosing a chord corresponding to the performance operation based on the tone pitches and for when the count of the tone pitches corresponds to the predetermined count, choosing a chord based on the tone pitches and the previous chord data;

(e) accompaniment performing means for performing an accompaniment based on said decided chord data.

A feature of the invented apparatus is that the chord data decision means is provided with fractional chord data decision means, which chooses a fractional chord, when the count of said tone pitches is two, based on said previous chord data and an difference between pitch names corresponding to the two tone pitches.

According to the apparatus of such a design, in response to the performance operation of a chord, key depression data and tone pitch data are generated. Key-count is detected by the key-count detection means which determines key depression data for the chord. The chord determination means then establishes a chord tone (to be generated from the output means) by comparing the played chord data with chord pattern data on the basis of the count of depressed keys and the tone pitch. This comparison process involves primary chord data containing information on the chord types and root notes of the previously played chord, which leads to a secondary chord data which provide the chord data which is outputted from a sound reproduction system.

BRIEF DESCRIPTION OF THE DRAWINGS

FIG. 5 is an example of the chord patterns stored in a chord pattern memory 9a.

FIG. 6 is a table to explain the rules for partial chord determination.

PREFERRED EMBODIMENT OF THE PRESENT INVENTION

The embodiment is explained in the following with reference to the accompanying figures.

I. Overall Configuration

Figure 1:
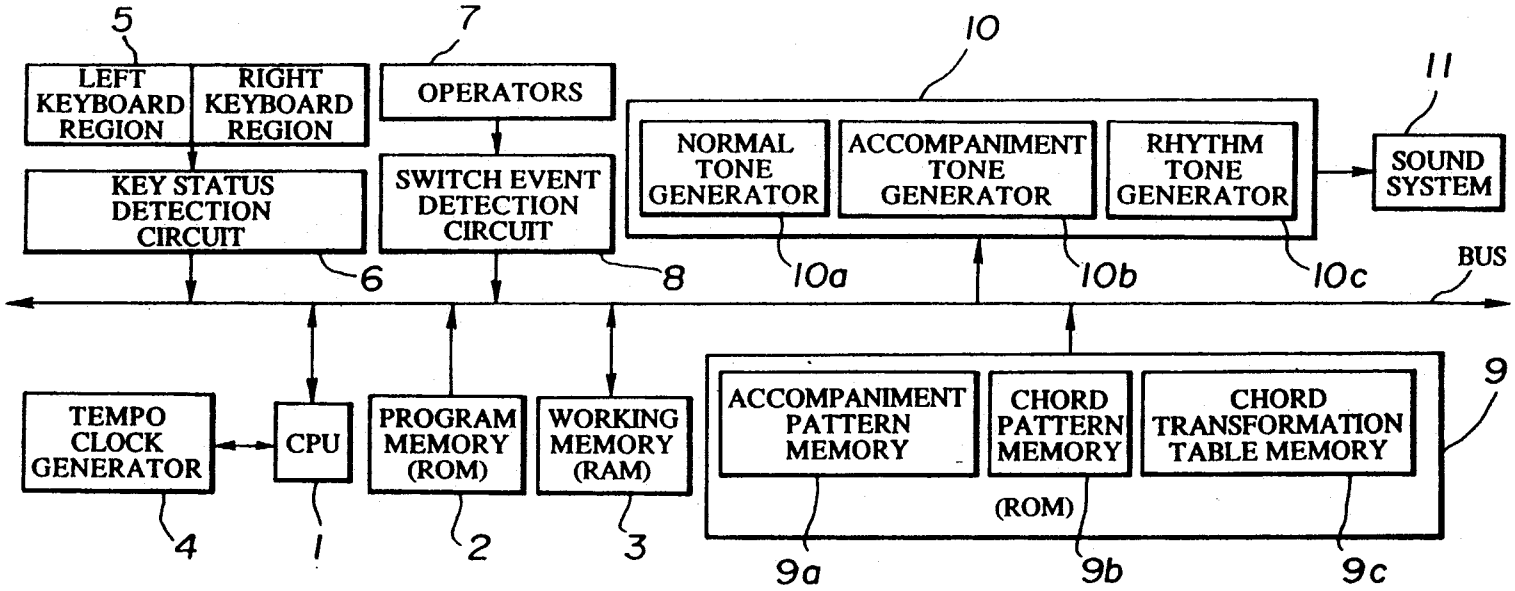
FIG. 1 is a block diagram of the structural configuration of an embodiment.

FIG. 1 is a block diagram to explain the structural arrangement of an embodiment. The numeral 1 refers to a central processing unit (CPU) which controls the tone generation process based on the signals supplied from the various sections, 2 is a program memory (ROM) which stores various control programs for CPU 1, 3 is a working area (RAM) for CPU 1, which temporarily stores such data as the results of computations and the values from the various registers, 4 is a tempo-clock generation circuit which generates and specifies the performance timing. Automatic base chord playing in the present invention refers to the action of generating a chord tone and a base tone of a chord automatically, at the timing specified by the above tempo-clock. When the tempo-clock is supplied to CPU 1, an interrupt process (which will be explained later) is performed by CPU 1 at a cycle specified by the tempo-clock.

The numeral 5 refers to a keyboard consisting of the left side keys for specifying chords and the right side keys for playing the melody. The numeral 6 is a key status detection circuit for determining the playing status of a key, played (depressed) or not played (at rest) according to the on-off status of a key switch which is provided for each key; and the key status circuit 6 outputs appropriate key on and key code signals corresponding to the depressed key. The numeral 7 represents various control operators which are disposed on the apparatus panel, and which consist of such operable items as auto bass chord start switch and pitch bend wheel which controls high pitch tones. The operating status of the various switches is determined and appropriate event signals are generated in the switch event detection circuit 8.

The numeral 9 represents data memory group (ROM), and consists of chord pattern memory 9b, chord transformation table 9c and accompaniment pattern memory (accompaniment table) 9a. The chord pattern memory 9b contains the identity information P1 for determining the identity of a chord. The details of the workings of the identity information P1 will be explained later. The chord transformation table 9c contains a table for converting tone pitch information of the tones comprising the chord into key code according to its detected chord type and its root note. The accompaniment table 9a contains pattern data, sufficient for a given bar, which control tone generation timing of the chord tone and base tone according to the tempo-clock. This pattern data is arranged so that the data corresponding to the rhythm types specified by the operators 7 can be outputted.

The numeral 10 represents a tone generator comprising, for example, known waveform memories. The tone generator 10 comprises normal tone source 10a, the accompaniment tone source 10b and rhythm tone source 10c. The accompaniment tone source 10b generates a chord tone corresponding to the key code in the chord transformation table memory 9c, according to the tone generation timing read out from the above mentioned accompaniment pattern memory 9a. The numeral 11 represents a sound system which amplifies the musical tone signal from the tone generator 9 and outputs it from a speaker system.

II. Operational Outline

Figure 2:
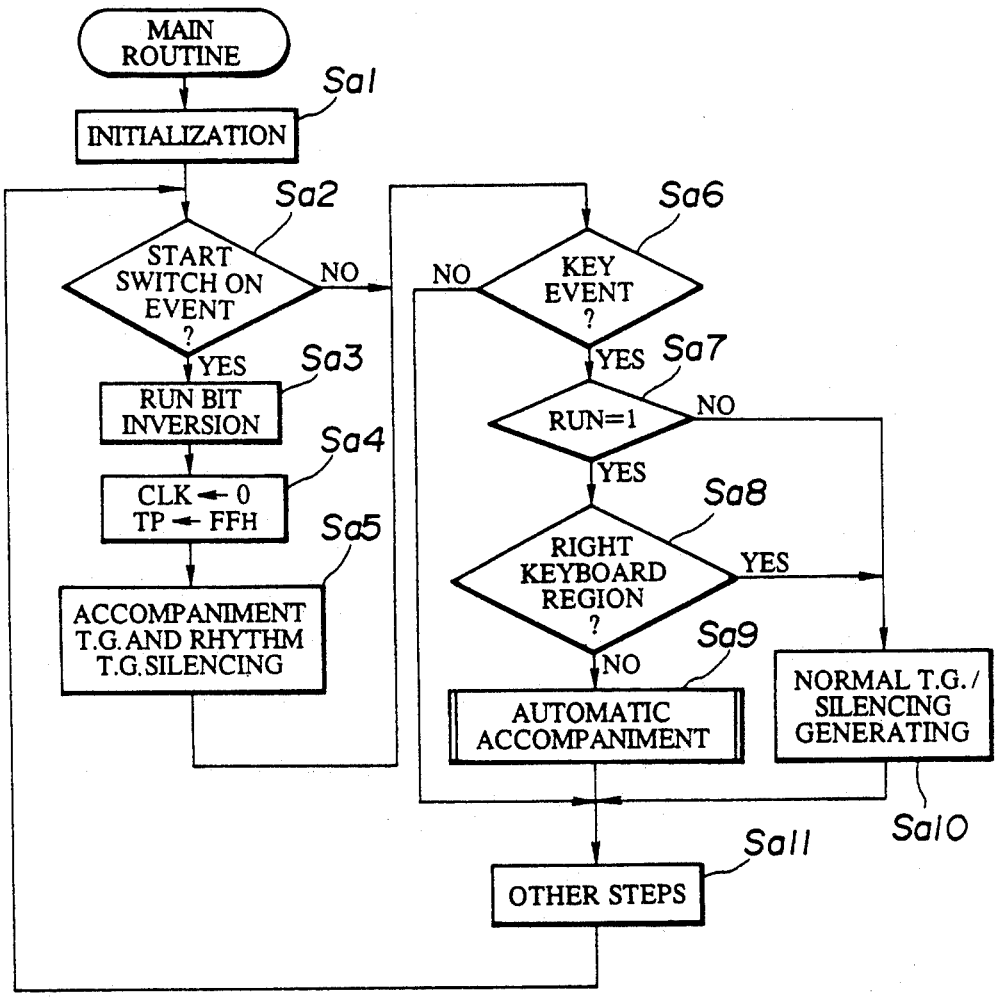
FIG. 2 is a flow chart showing the steps in the main routine in the embodiment.

The outline of the operation of the embodiment according to the above described structural configuration will be described with reference to the flow chart shown in FIG. 2.

When the power is turned on, CPU 1 is loaded with the control programs stored in the program memory 2, which activates the main routine and the program advances to step Sa1. In step Sa1, an initialization step is performed which resets the contents of such memories as the registers. In step Sa2, it (the program) examines whether the start switch has been activated, i.e. the on-event of the start switch has been activated. When the on-event is detected, the result of the step is [YES], and it proceeds to step Sa3. In step Sa3, the content of the register RUN is reversed. The register RUN stores start/stop data for the rhythms, and the bit inversion from [0] to [1] of this data indicates rhythm-start event. In step Sa4, the register CLK is set to [0], and the register TP is set to [FF (base 16)]. The register CLK stores data for accompaniment timing and the register TP memorizes the chord type of the detected chord. Also, when the register TP contains a value for [FF], it signifies that the chord type has not been detected. In step Sa5, a tone muting step is carried out for the accompaniment tone source 10b and the rhythm tone source 10c. It then proceeds to step Sa6.

In the meanwhile, if the start switch has not been operated in the above step Sa2, the result is [NO], and it advances to step Sa6. In step Sa6, it examines whether or not the key-on signal from the key status detection circuit 6 has been forwarded. If the key-on signal is confirmed, the result is [YES], and it proceeds to step Sa7. In step Sa7, it judges whether or not the rhythm-start has been operated, according to the content of the register RUN, i.e. whether the content is set to [1]. If the start switch on-event is detected in step Sa2, i.e. the register content RUN is [1], the result is [YES], and it proceeds to step Sa8. In step Sa8, it examines whether the depressed keys belong in the right side key region. If the depressed key is in the left region of the keyboard, the result is [NO], and it proceeds to step Sa9. In step Sa9, the chord type and the root note for the depressed chord are determined, and based on this information, an automatic accompaniment routine is carried out. This routine will be described in detail later.

In contrast, in the event that the keys are depressed, although the aforementioned start switch has not been operated, or in the event that although the start switch has been activated, the chord in the left keyboard region is not played, the above step Sa7 results in [NO], or step Sa8 results in [YES], and in either case, it proceeds to step Sa10, and the musical tone of the key code tone corresponding to the depressed keys is outputted from the normal sound source 10*a*.

In the main routine, the following summarized processes take place.

(A) In the case of start status

When a chord is played in the left keyboard region, the chord type and the root note are detected, and based on this information, automatic accompaniment is played as will be described later. On the other hand, when a melody is played in the right keyboard region, the musical tones of the key codes corresponding to the depressed keys are generated from the normal sound source 10*a*. After performing the various tasks shown in step Sa11, it returns to step Sa2, and repeats the steps Sa2–Sa11.

(B) In the case of non-start status

In this case, because the rhythm step cannot be started, chord examination is not performed even if the keys in the left keyboard region are played. Only the step of sound generation or muting corresponding to the depressed keys in the right region of the keyboard are carried out for the normal sound source 10*a*. In step Sa11, other steps are carried out, and it returns to step Sa2 to repeat the steps Sa2–Sa11.

(III) Operations Of Automatic Accompaniment Routine

This routine is activated when the start switch has been activated, and a chord in the left keyboard region is played. By the operation of this routine, automatic playing of a chord, based on the detected chord type and the root note, is carried out in harmony with the melody playing in the right keyboard region. This automatic accompaniment routine consists of a search routine, a fractional chord detection routine and a chord determination routine. The operations of the various programming steps involved in these processes will be described in the following.

(III-1) Chord Detection Routine, Sb

Figure 3:
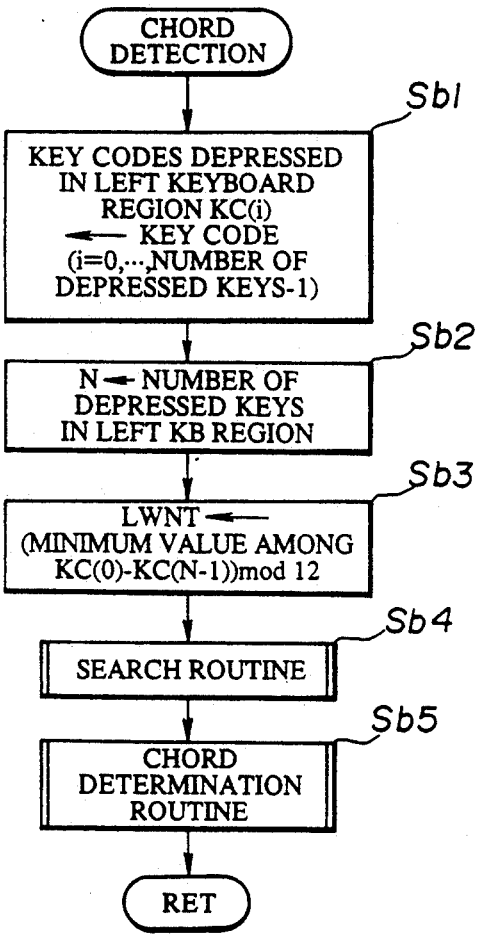
FIG. 3 is a flow chart showing the steps in the chord detection routine in the embodiment.

When the processing in CPU 1 proceed to step Sa9, the chord detection routine shown in FIG. 3 is activated, and it proceeds to step Sb1. In step Sb1, based on the key-on signal and the key code signal forwarded from the key status detection circuit 6, all the key codes of the depressed keys in the left keyboard region are taken into an array KC(i). In this case, i assumes a value between [0] and one less than the number of depressed keys. Proceeding onto step Sb2, the count of the depressed keys in the left keyboard region is established as N, and it proceeds to step Sb3. In step Sb3, the mod 12 (modulo 12 residue) for the minimum value of the array KC(0)-KC (N-1) is obtained, and the minimum note number thus obtained is entered in the register LWNT. Next, it returns to the main routine via the search routine (Sb4) and the chord determination routine (Sb5).

(III-2) Search Routine Steps, Sc

Figure 4:
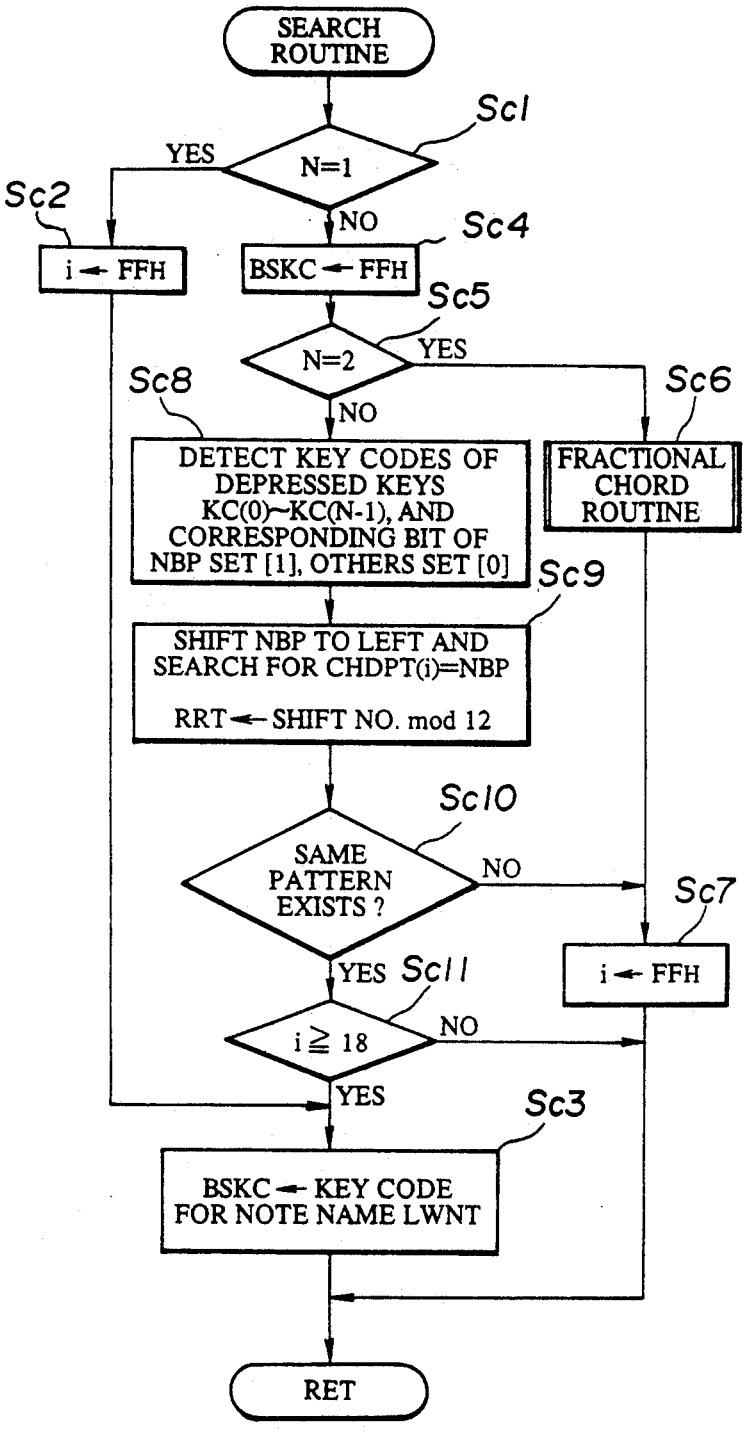
FIG. 4 is a flow chart showing the steps in the search routine in the embodiment.

When the processing in CPU 1 proceeds to step Sb4, the search routine shown in FIG. 4 is activated, and it proceeds to step Sc1. In step Sc1, the search is made to determine whether the count of the depressed keys is [1], i.e. a single depressed key or not. When it is a single depressed key, the result is [YES], and it proceeds to step Sc2. In step Sc2, because a chord cannot be formed for a single key, a search parameter i (which will be described later) is established in [FF (base 16)], and it proceeds to the next step Sc3. In step Sc3, the key code formed by the single depressed key is assumed to be the bass tone of the key code and it is entered into register BSKC.

On the other hand, when the depressed key is not a single key, it results in [NO] in step Sc1, and it proceeds to step Sc4. In step Sc4, [FF (16 base)] is entered into the register BSKC. If the register BSKC is [FF], it indicates that the bass tone of the key code has not been determined. Proceeding onto step Sc5, it examines whether or not the key depression play is the abbreviated type, i.e. the play involving a two-key depressed chord. If the play is a two-key depressed chord, the result is [YES], and it proceeds to step Sc6. In step Sc6, fractional chord detection routine (described later, and is referred to as fractional chord routine) is carried out. This fractional chord routine is concerned with treating a two-key depressed chord according to certain rules. If, in step Sc6, the fractional chord is judged to a two key depressed chord, it proceeds to step Sc7, and makes the search parameter i to be [FF (16 base)], and completes this search routine. If the fractional chord is not a two-key depressed chord, i.e. when over three tones are generated in the left keyboard region, the result is [NO] in step Sc5, and it proceeds to steps Sc8 and Sc9, and based on the aforementioned identity information P1 stored in the chord pattern memory 9*b*, the chord type and the root note are determined.

The identity information P1 will be explained with reference to FIG. 5. This information refers to a table CHDPT (i) containing chord pattern data expressed as bit patterns for every 12 tones, so as to correspond with the search parameter "i". The pattern data in this table CHDPT (i) are compared and matched with the bit-pattern of key codes to correspond with the depressed keys. For example, when the root note is C, and if the keys 1 degree (C), 3 degree (E) and 5 degree (G) are depressed, the bit pattern to correspond with this tone pattern will be selected as the correct chord type which is a major Maj.

Proceeding further to step Sc8 shown in FIG. 4, it examines whether all the bit patterns recorded in the array KC, which was carried out in the aforementioned step of chord determination routine, and those bit patterns matching the depressed keys are present in the register NBP (12 bit). In other words, in this register NBP, the bits which match with the key codes of the depressed keys are set to [1] while the remainders are set to [0]. In the next step Sc9, the content of the register NBP is shift rotated to the left, and the search parameter i is progressively incremented to search through the table CHDPT (i). This search methodology is the same as in the known rotation technique. This matching search results in a tentative root note RRT while the matched bit pattern becomes the selected chord type.

In the next step Sc10, it examines whether there is a matched bit pattern resulting from the search step, and if there is no match, the result is [NO], and it proceeds to step Sc7, and sets the search parameter i to [FF] to indicate that there is no matching. If matching is found, the result is [YES] and it proceeds to step Sc11. In step Sc11, it examines whether the search parameter, for the matched chord, is over 18. If the search parameter i is over 18, the matched pattern is regarded as "inharmonic", as shown in the table shown in FIG. 5. If the matched pattern is not "inharmonic", the result is [YES], and this search routine is completed. In the case of "inharmonic", it returns to the aforementioned step Sc3. That is, the lowest tone in the depressed keys is considered to be the bass tone of key code and is established in the register BSKC to complete this routine.

(III-3) Fractional Chord Routine, Sd

Before explaining the operations of the fractional chord routine, the rules of selecting fractional chord in this routine will be explained with reference to the table shown in FIG. 6. This table shows the rules concerning the determination of a two-key depressed chord based on the presently depressed two-key chord and a previously detected chord. This table shows eleven combinations of fractional chord types, basing the reference tone on the lowest tone of the two tones. For example, if a C (doh) and a D (re) are depressed, and the previous chord was a D minor (Dm) or a D minor seventh (Dm7), then the fractional chord is regarded to be Dm7/C, which means chord tone Dm7 and the bass tone C.

Figure 7:
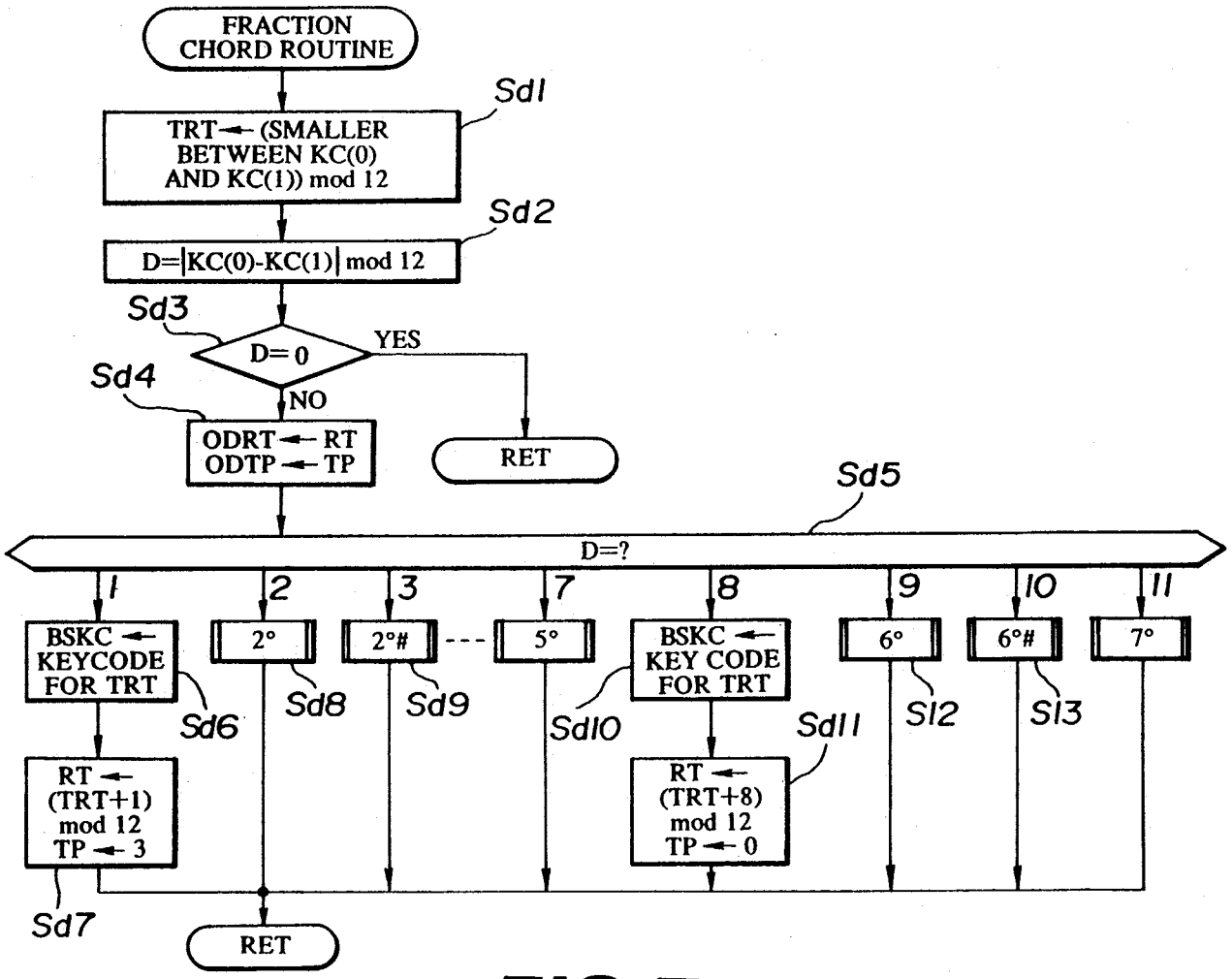
FIG. 7 is a flow chart showing the steps in the fractional chord routine in the embodiment.

The operation of the fractional chord routine based on the above selection rule will be explained. First, the CPU 1 processing reaches the step Sc6, the fractional chord routine shown in FIG. 7 is activated, and it proceeds to step Sd1. In step Sd1, the note number for the lower tone of the two depressed key codes is selected, and its mod 12 is obtained (modulo 12 residue) and is established in the register TRT. The key code present in this register TRT is used as the reference ton (bass tone) in the above selection rule (refer to FIG. 6). In step Sd2, the difference in the degrees between the high note and the low note is obtained, and its excess mod 12 is placed in register D, and it proceeds to step Sd3. In step Sd3, it examines whether the content of the register D is [0] or not. If D=0, both keys have the same key code, and a fractional chord cannot be established, and the routine is completed. On the other hand, if the register D is not [0], the result is [NO], and it proceeds to step Sd4.

In step Sd4, the root note RT and the chord type TP of the two-key depressed chord which have been previously detected are memorized in the registers ODRT and ODTP, respectively. In step Sd5, the processing is separated into two paths depending on the content of the register. That is, the selection rule is applied based on the difference in the degree of the high tone and the low tone keys. As a representative case example, the following explanation is provided for the case of D being 1, 2, 3, 8, 9 and 10. Other processing is similar to this case, and the explanations are omitted.

(III-3-i) When D=1

This case corresponds to the case of ]C+C#] in the aforementioned selection rule shown in FIG. 6, and without depending on the previous chord, D flat major seventh on C ($D_b$M7/C) is unilaterally selected. That is, in step Sd 6, the note number stored in the register TRT is converted to the key code in the corresponding keyboard region, and is present in the register BKSC. By this operation, the lower of the two depressed keys becomes the reference tone (bass tone), using the data in the aforementioned chord transformation table 9c. In step Sd7, the chord type and the root note are determined on the basis of the data in the identity information P1 shown in FIG. 5, and in this particular case, since the chord type is major seventh (M7th), the chord identity number TP is [3]. Because the D flat is a semitone higher than the reference tone C, [1] is added to the register TRT, and by taking the excess mod 12, the root note RT is obtained.

By such procedure, fractional chords are chosen and the chord type TP and the root note RT which constitute the chord are established, thus completing the fractional chord routine.

(III-3-ii) When D=2

This case corresponds to the case of [C+D] in the selection rule, and the selected fractional chord changes in accordance with the previously played chord. To achieve such a result, the selection routine involves a two degree selection processs.

Figure 8:
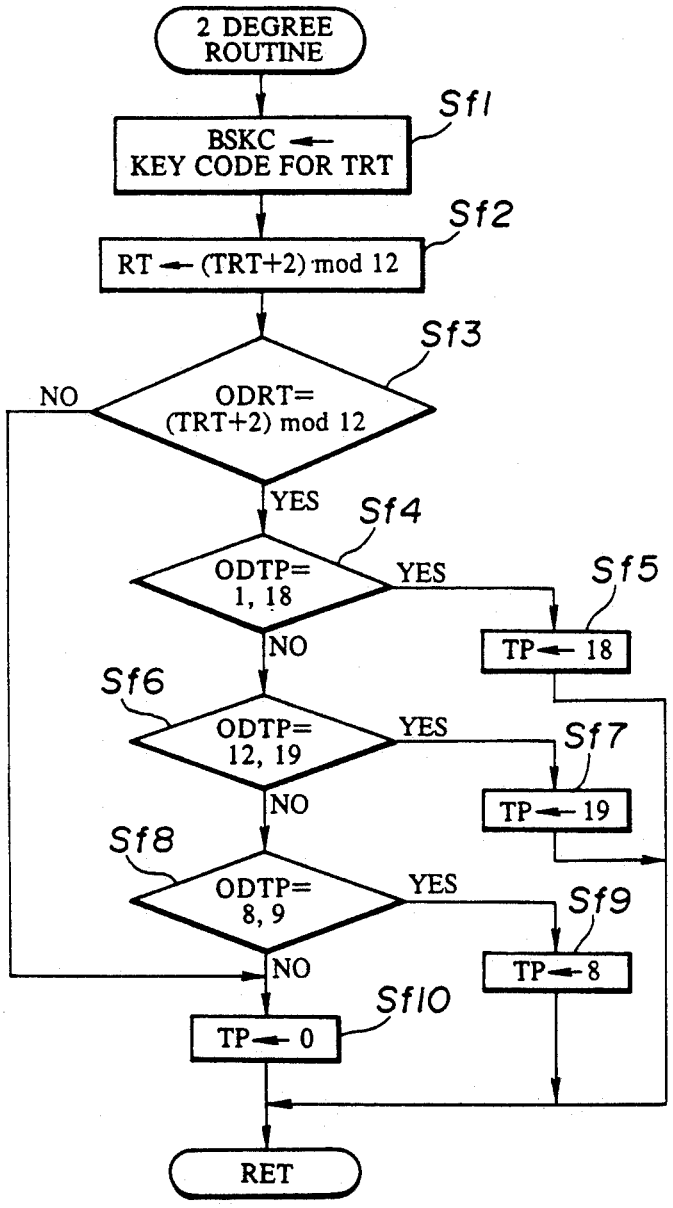
FIG. 8 is a flow chart showing the steps in the 2 degree detection routine in the embodiment.

In this case, this selection process is activated in the step Sd8 shown in FIG. 8, and the process begins at the first step Sf1. In step Sf1, a note number stored in the register TRT is converted to a key code in the corresponding keyboard region, and is present in the register BSKC, thus making the lower tone of the two depressed keys as the bass tone. Proceeding onto step Sf2, [2] is added to the register TRT, and by taking the mod 12, the root note RT is obtained, and it proceeds to step Sf3. In step Sf3, the root note RT obtained in the previous step Sf2 is compared with the root note ODRT of the previously played chord, in this particular case, a D note. If it is the same root note, the result is [YES] and the corresponding fractional chord is selected in step Sf4, according to the selection rule shown in FIG. 6.

In step Sf4, it examines whether the previous chord type TP is 1 (minor m) or 18 (minor seventh m7th), and if it matches with either of the two, then it proceeds to step Sf5, and selects the chord type TP to be [18] (m7th). If matching is not obtained, the result is [NO], and it proceeds to the next step Sf6. In step Sf6, it examines whether the previous chord type TP matches with [12] (mM7-5) or 19 (m7th-5), and if matching is obtained with one of the two, then it proceeds to step Sf7, and it selects the chord type TP as [19] (m7th-5). If neither matches, then it proceeds to step Sf8. In step Sf8, the present chord type TP[8] (7th-5) or TP[9] (m7th-5) are examined. If one matching is obtained, it proceeds to step Sf9, and the fractional chord is judged to be type TP[8] (7th-5). If neither matches, then it proceeds to step Sf10, the chord type TP is selected to be [1] (major).

(III-3-iii) When D=3

Figure 9:
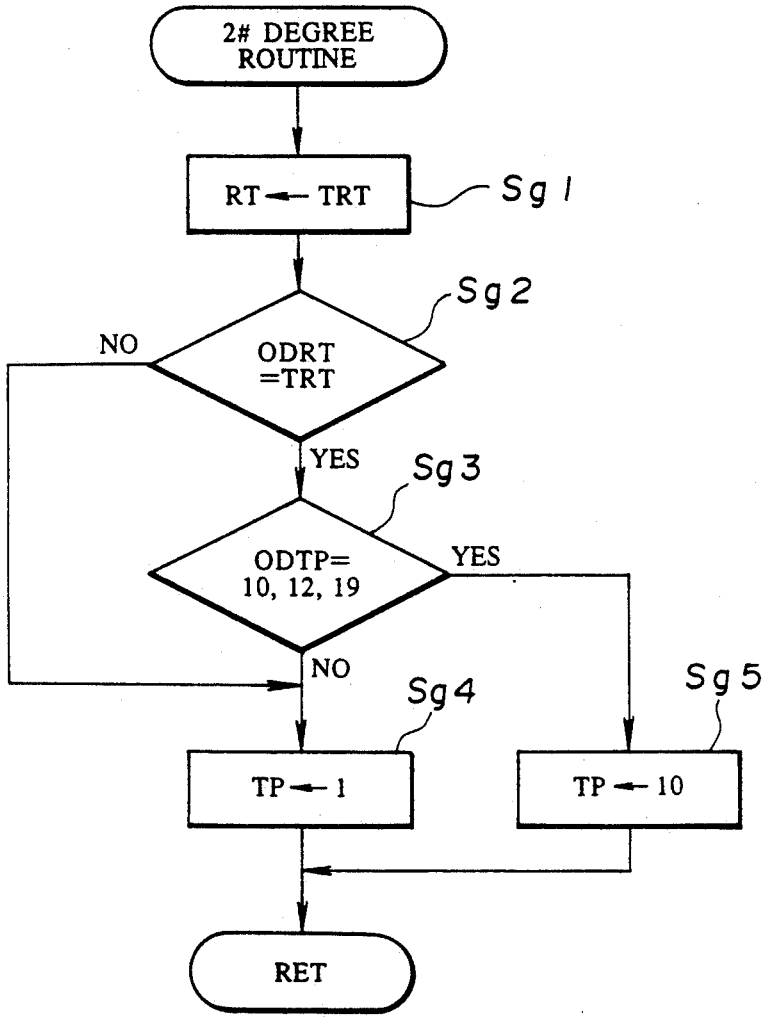
FIG. 9 is a flow chart showing the steps in the 2 # degree detection routine in the embodiment.

This case corresponds to the case of [C+D] in the selection rule summarized in the Table in FIG. 6, and it proceeds to step Sd9, thus activating the 2# selection routine shown in FIG. 9, and the process begins at the step Sg1. In this step, a value stored in the register TRT is made to be the root note RT. Next, in step Sg2, it examines whether this root note RT is the same as the root note of the previous chord. If the two notes are the same, the result is [YES], and it proceeds to step Sg3. If the two are not the same, the result is [NO], and it proceeds to step Sg4.

In step Sg3, it examines whether the previous chord type ODTP is one of [10] (minor flat five m-5), [12]

(mM7-5) or [19] (m7-5). If it is none of these, the result is [NO] and it proceeds to step Sg4. In step Sg4, a chord type TP is established as [1] (m). If one matching is obtained, it proceeds to step Sg5, and the chord type is established as [10] (m-5) as in FIG. 6.

(III-3-iv) When D=8

In this case, as in the aforementioned case of D=1, the fractional chord does not depend on the previously played chord, and the chord is unilaterally established as $A_b$/C. In step Sd10, a value in the register TRT is converted to the key code in the corresponding range of note, and this value is registered in the register BSKC, and the lower of the two tones is made to be the bass tone. In step Sd 11, chord type TP is established as [0], and [8] is added to the register TRT, and its mod 12 is obtained to select the root note RT.

(C-3-v) When D=9

Figure 10:
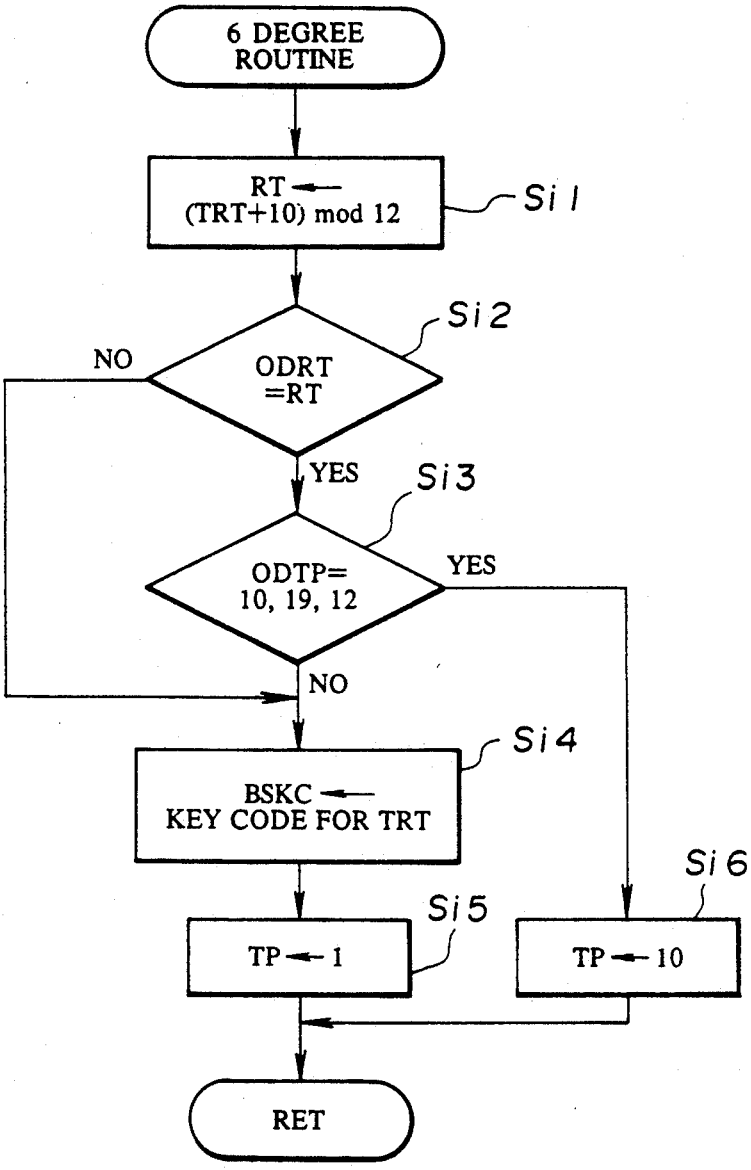
FIG. 10 is a flow chart showing the steps in the 6 degree detection routine in the embodiment.

This case corresponds to the case of [C+A] in the selection rule summarized in the Table, and the 6 degree selection routine shown in FIG. 10 is activated by proceeding to step Sd12 which begins step Si1. In step Si1, [10] is added to the register TRT, and by taking mod 12 of this value, the root note RT is obtained, and it proceeds to step Si2. In step Si2, it examines whether the root note RT is the same as the root note ODRT of the previous chord. In this particular case, this means whether it is an [A] note or not. If the root notes are the same, the result is [YES], and it proceeds to step Si3, and if they are not the same, it proceeds to step Si4.

In step Si3, it examines whether the chord type ODTP of the previously played chord is one of [10] (m-5), [12] (mM7-5) or [19] (m7-5). If matching is not obtained, the result is [No] and it proceeds to step Si4. In step Si4, the value of the register TRT is converted to the key code in the corresponding range of notes, and this value is present in the register BSKC, thus making the lower tone of the two depressed keys the bass tone, and in the next step Si5, the chord type TP is established as [1] (m).

In the meantime, in the above step Si3, if the chord type ODTP does not match with any of the [10], [12] or [19], it proceeds to step Si5, and sets the chord type TP to be [10] (m-5).

(III-3-vi) When D=10

Figure 11:
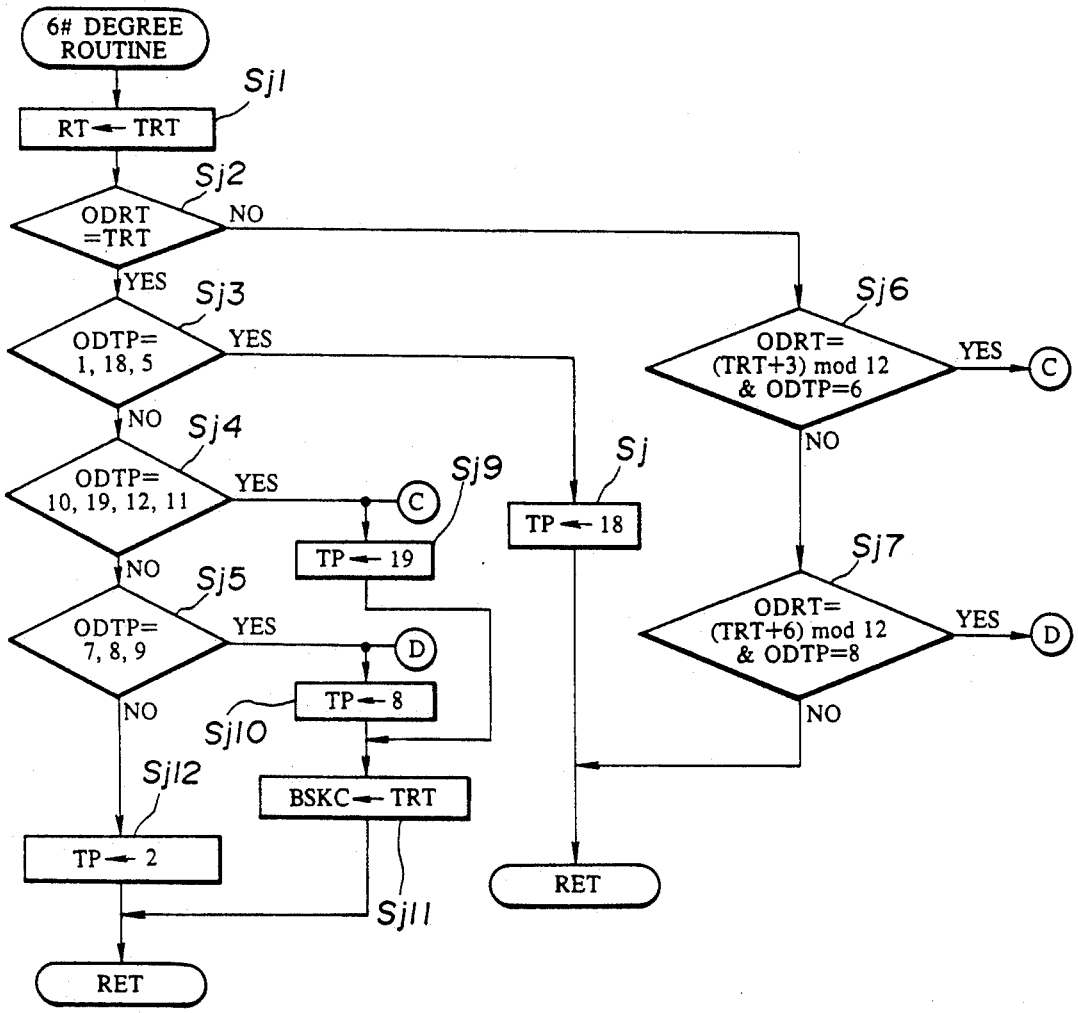
FIG. 11 is a flow chart showing the steps in the 6 # degree routine in the embodiment.

This case corresponds to the case of [C+A#] in the selection rule shown in the Table (in FIG. 6), and the selection routine, shown in FIG. 11, is activated by proceeding to the step Sd13, which invokes step Sj1. In step Sj1, a note number in the register TRT is made to be the root note RT, and it proceeds to step Sj2. In step Sj2, it examines whether the root note RT is the same as the previously played root note ODRT. If the two are the same, in the subsequent steps Sj3, Sj4 and Sj5, it examines for the identity of the previous chord with the chord type ODTP. The following explains the process of this analysis.

(III-3-vi-a) The root note RT is different from the previous root note ODRT

In this case, it proceeds to step Sj6, and it examines whether the root note ODRT fulfills the following conditions. First, [3] is added to the register TRT, and it examines whether the mod 12 value of the root note RT is the same as the root note ODRT, and whether the previously played chord type ODTP is [6] (m6th). If these conditions are not met, it proceeds to step Sj7, and adds [6] to the register TRT, and examines whether the mod 12 value of the root note RT is the same as the root note ODRT, and whether the previously played chord type ODTP is [6] (m6th). These examinations are for the purpose of determining whether the previously played chord is a $E_b$m6 or a $G_b$7-5. When the conditions in the step Sj6 are satisfied, it proceeds to step Sj9, and when the conditions in step Sj7 are fulfilled, it proceeds to Sj10, to specify the chord type TP. The operations of both steps Sj9 and Sj10 will be explained shortly.

(III-3-vi-b) Previous chord type matches with one of [1], [18] or [5]

In this case, it proceed to step Sj8, and the chord type TP is established as [18] (m7th).

(III-3-vi-c) Previous chord type matches with one of [10], [19] or [12]

In this case, it proceeds to Sj9, and the chord type TP is established as [19] (m7th-5).

(C-3-vi-d) Previous chord type matches with one of [7], [8] or [9]

In this case, it proceeds to Sj10, and the chord type TP is established as [8] (7th-5). If the chord type TP is determined in one of the steps (vi-a to vi-d) above, then it proceed to step Sj11, and the value stored in the register TRT, i.e. the root note RT in this particular case is established in the register BSKC, and it is made to be the bass tone of the fractional chord. If no matching is obtained in the steps (vi-a to vi-d), it proceeds to step Sj12, and the chord type TP is established as [2] (7th).

(III-4) Operation of the Chord Identification Routine

In the search routines presented so far, chord patterns and the tentative root notes RRT of the depressed keys were determined by pattern matching. However, the matching process was unable to determine whether the chord is in the basic form or in the inverted form. Therefore, in this routine, analysis is carried out to determine the true root note RT and its chord type TP of played chord. This analysis is carried out particularly for those chord patterns shown in FIG. 5 having the search parameter i values [4], [6], [8], [11], [13], [16] and [over 18]. In other words, this chord identification process decides whether it is the basic form or the inversion form from the relative tone pitches of the tones constituting a chord. For example, if the search parameter i is [4], and if the lowest tone of a chord is the root note, it is the basic form, and decides that the chord type is sixth (6th), and all other cases are inversion and the chord type is taken as minor seventh (m7th). The identification process is explained in more detail in the following.

Figure 12:
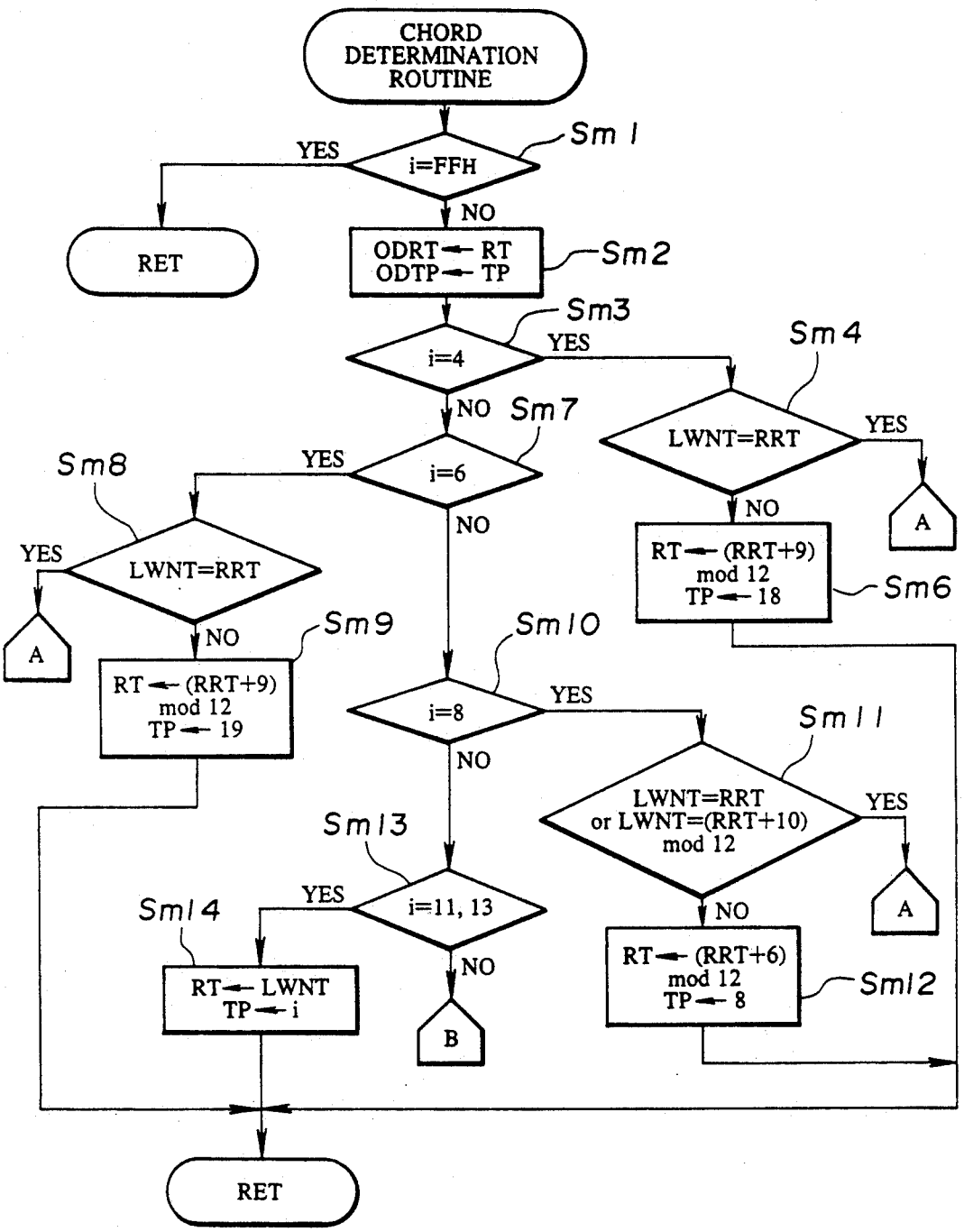
FIG. 12 is a flow chart showing the steps in the chord determination routine in the embodiment.
Figure 13:
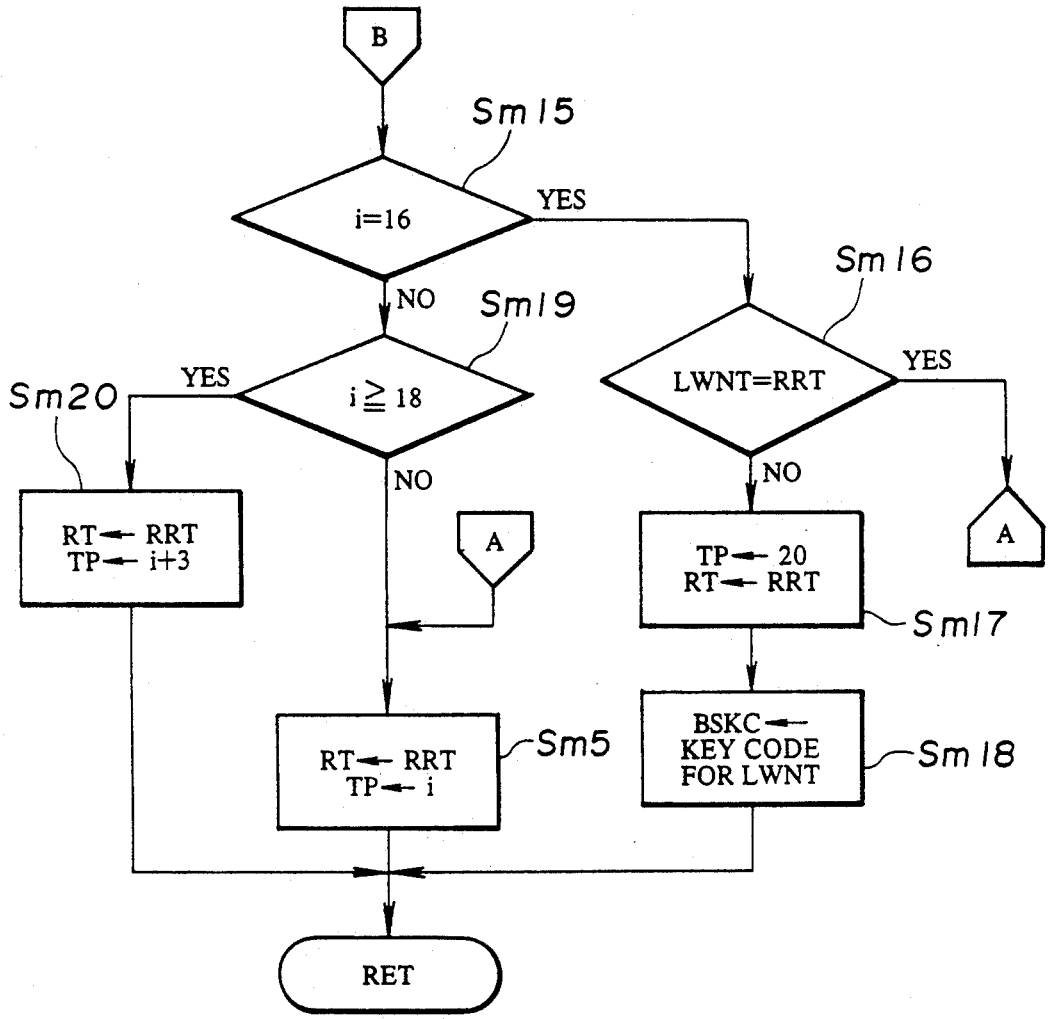
FIG. 13 is a flow chart showing the steps in the chord determination routine at point B in FIG. 12.
Figure 14:
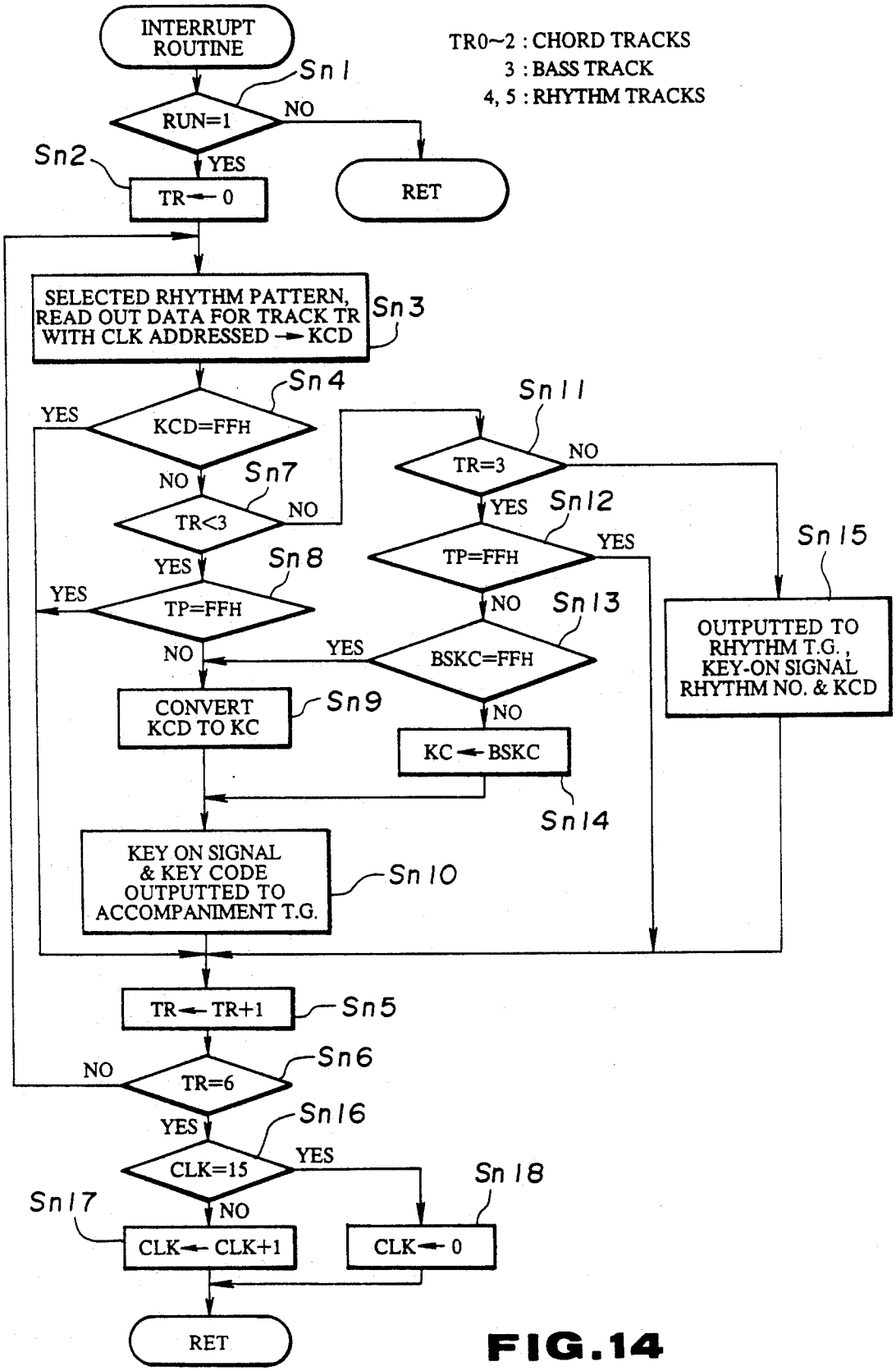
FIG. 14 is a flow chart showing the steps in the interrupt process routine in the embodiment.

When the processing by CPU 1 proceeds to step Sb5 (chord determination routine in FIG. 3), the chord identification routine shown in FIGS. 12 and 13 is activated, and the process begins at the step Sm1. In step Sm1, it examines whether or not the search parameter i is present in [FF (base 16)]. This parameter i is used when the chord pattern was not found in the aforementioned search routine. Therefore, when the parameter i is present in [FF], chord determination cannot be made until the search routine is completed. When the search parameter i is not in [FF], then the result is [NO] and it proceeds to step Sm2. In step Sm2, the previously played root note RT and the chord type TP are retained as the previous root not ODRT and chord type ODTP.

Subsequently, the chord determination is repeated for each chord as described above.

(III-4-i) Chord Determination when i=4

In this case, the step Sm3 results in [YES], and it proceeds to step Sm4. In step Sm4, it examines whether the note number in the register LWNT in the chord determination routine matches with the tentative root note RRT, i.e. whether the tentative root note RRT is the lowest tone or not. If the tentative root note RRT is the lowest tone, the result is [YES], it proceeds to step Sm5 shown in FIG. 13, and accepts the tentative root note RRT as the true root note RT, and the chord type TP is established as [4], and this routine is completed.

In the meanwhile, if the tentative root note RRT is not the lowest tone, the result is [NO] and it proceeds to step Sm6. In step Sm6, [9] is added to the tentative root note RRT, and its mod 12 is established as the true root note RT, and the chord type TP is established as [18] (inversion of m7th).

(III-4-ii) Chord Determination when i=6

In this case, the result of step Sm7 is [YES], and it proceeds to Sm8. In step Sm8, it examines whether the tentative root note RRT is the lowest tone or not. If the tentative root note RRT is the lowest tone, the result is [YES], it proceeds to step Sm5 shown in FIG. 13, and accepts the tentative root note RRT as the true root note RT, and the chord type TP is established as [6] (basic form of m6th).

In the meanwhile, if the tentative root note RRT is not the lowest tone, the result is [NO] and it proceeds to step Sm9. In step Sm9, [9] is added to the tentative root note RRT, and its mod 12 is established as the true root note RT, and the chord type TP is established as [19] (inversion of m7th-5).

(III-4-iii) Chord Determination when i=8

In this case, the result of step Sm10 is [YES], and it proceeds to Sm11. In step Sm11, it examines whether the tentative root note RRT is the lowest tone or not, and also whether the lowest tone is the same as the mod 12 value of tentative root note RRT plus [10]. If either of these two conditions is fulfilled, the result is [YES], and it proceed to step Sm5 shown in FIG. 13 and accepts the tentative root note RRT as the root note RT, and the chord type TP is established as [8] (basic form of 7th-5).

In the meanwhile, if none of the above conditions is met, the result is [NO] and it proceeds to step Sm12. In step Sm12, [6] is added to the tentative root note RRT, and its mod 12 is established a the true root note RT, and the chord type TP is established as [8] (inversion of 7th-5). (C-4-iv) Chord Determination when i=11, 13

In this case, the result of step Sm13 is [YES], and it proceeds to Sm14. In step Sm14, the lowest tone stored in the register LWNT is established as the true root note RT, and the chord type TP is established as [11] (m6th-5) or [13] (m+5).

(III-4-v) Chord Determination when i=16

In this case, the result of step Sm15 shown in FIG. 13 is [YES], and it proceeds to Sm16. In step Sm16, it examines whether the tentative root note RRT is the lowest tone or not. If the tentative root note RRT is the lowest tone, the result is [YES], it proceeds to step Sm5, and accepts the tentative root note RRT as the true root note RT, and the chord type TP is established as 1[6] (suspended fourth sus4), and this routine is completed.

In the meanwhile, if the tentative root note RRT is not the lowest tone, the result is [NO] and it proceeds to step Sm17. In step Sm17, the tentative root note RRT is established as the true root note RT and the chord type TP is established as [20] (the first inversion of inharmonic 4). It proceed to step Sm18, and the value of the register LWNT is converted to the key code in the range of notes, and this value is set to the register BSKC to establish it as the bass tone.

(III-4-vi) Chord Determination when i≧18

In this case, the result of step Sm19 shown in FIG. 13 is [YES], and it proceeds to step Sm20. In step Sm20, the tentative root note RRT is established as the true root note RT, the chord type TP is established to be [21]-[23] (inharmonic 1-3) which number is obtained by adding [3] to the search parameter i, and this routine is completed.

III-5 Operations of the Interrupt Routine

The parameters obtained in the above described routines are used in the interrupt routine which is activated at regular intervals by the tempo-clock. The interrupt routine activates the accompaniment tone source 10*b* and the rhythm tone source 10*c* (which will be explained later) which provide automatic accompaniment playing. The signal generated by the tempo-clock generation circuit 4 is supplied to CPU 1, at every ⅛ beat for example, and at each interval, the interrupt routine is activated to proceed to step Sn1.

In step Sn1, it examines whether a [1] is present in the aforementioned register RUN, i.e. whether the apparatus is in the rhythm-start condition or not. If the register is [0], rhythm will not start, and the result is [NO], and this routine is terminated. If the rhythm is on, it proceeds to the next step Sn2. In step Sn2, the track number of the reproduction track is reset to zero. In this embodiment, there are five reproduction tracks, and the tracks are designated as: track numbers 0-2 for chord tracks, 3 for bass track and 4,5 for rhythm tracks.

In step Sn3, a rhythm pattern to correspond with the selected accompaniment type is selected, and according to the address of the supplied tempo-clock CLK, the data recorded in the reproduction track is read out, and this data is established as the key code data KCD. This reproduction track is defined by the track number TR. Proceeding to step Sn4, it examines whether the key code data KCD is [FF (base 16)] or not. If the key code data KCD is in [FF], the result is [YES], and it proceeds to step Sn5, to increment the present track number TR, and proceeds to step Sn6. In step Sn6, it examines whether all the tracks 0-5 have been filled with the necessary data, and the reproduction process is continued until all the tracks have been operated on as described in the following.

(C-5-i) Chord Track Reproduction

When the key code data KCD is not in [FF], and also the track number TR is less than [3], the result of step Sn6 is [YES], and the reproduction of a chord track is carried out.

In this case, it first proceeds to step Sn8, and it examines whether the chord type TP is set to [FF], i.e whether the chord type TP has been determined for the accompaniment routine. If the chord type TP has not been determined, it proceeds to step Sn5, and increments the track number TR by [1]. On the other hand, if the chord type TP has been determined, the result is [NO], and it proceeds to the next step Sn9. In step Sn9, the key code data KCD is converted into chord key KC, based on the root note RT and the chord type TP, and using the chord transformation table 9*b*. Proceeding to step Sn10, this key code KC and key-on signal are outputted to accompaniment tone source 10*b*. As the result of this, tone source 10*b* generates the chord tone corresponding to the channel in the chord track, thereby accomplishing the chord playing.

(III-5-ii) Bass Track Reproduction

This operation is performed when the result of step Sn11 is [YES], i.e. the track number is [3]. Proceeding to step Sn12, it examines whether the chord type TP is set to [FF], i.e. whether the chord type TP has been determined in the aforementioned accompaniment routine. If the chord type TP has not been determined, it proceeds to step Sn5, and increments the track number by [1]. If the chord type TP has been determined, it examines in step Sn13 whether the bass tone has been determined.

If the bass tone has not been determined, the key-on signal and the chord key KC are outputted, via steps Sn9 and Sn10, to the accompaniment tone source 10*b*. The result is the generation of a bass tone by the accompaniment tone source 10*b* from the location corresponding to the bass track.

If the bass tone has been determined, the result of step Sn13 is [NO], and it proceeds to step Sn 14. In step Sn 14, the bass tone stored in the register BSKC is established as the key code KC. Next, by going through the step Sn10, a bass tone is generated by the accompaniment tone source 10*b* to correspond with the channel in the bass track.

(III-5-iii) Reproduction of Rhythm Tracks

This operation is carried out when the result of step Sn11 is [NO], i.e. the track number TR is larger than [3]. Proceeding to step Sn15, the key-on signal generated from the key status detection circuit 6, the rhythm type selected by the operators 7 and the key code data KCD are supplied to the rhythm tone source 10*c*. The result is the generation of a rhythm tone by the rhythm tone source 10*c* from the channel corresponding to the rhythm track. This rhythm tone is generated regardless of the determination of chords.

When the reproduction of the above steps (III-5-i) to (III-5-iii) are completed, the result in step Sn6 becomes [YES], and it proceeds to step Sn16. In step Sn16, it examines whether the value of the register CLK is [15], and if it is not, the register CLK is incremented by [1] (in step Sn17), and if it is [15], it is reset to zero in step Sn18, and this accompaniment routine is terminated.

As described above, in this embodiment, the performer plays a chord in the left keyboard region of the keyboard 5, and if this is the fractional chord type, i.e. the abbreviated two-key depression type, the apparatus selects a chord consistent with the previously played chord. Further, if the specified chord consists of more than two keys, then either the basic form or the inversion form of a chord is detected, and based on the root note of this chord data and the chord type, this chord tone is supplied to the accompaniment tone source 10*b*. Therefore, the invented apparatus provides automatic accompaniment to a melody based on accurate and fitting chord tones appropriate to the musical score.

What is claimed is:

1. An automatic accompaniment apparatus for an electronic musical instrument comprising:

(a) performance data generating means for generating tone pitch data in response to a performance operation;

(b) key-count detection means for detecting a count of tone pitches designated by the tone pitch data, and for generating count data representing the count of the tone pitches;

(c) chord data memory means for storing previous chord data representing a chord type and a root note, the previous chord data corresponding to a performance operation played previously;

(d) chord data decision means for, when the count of the tone pitches does not correspond to a predetermined count, choosing a chord corresponding to the performance operation based on the tone pitches and for, when the count of the tone pitches corresponds to the predetermined count, choosing a chord based on the tone pitches and the previous chord data; and (e) accompaniment performing means for performing an accompaniment based on said decided chord data.

2. An automatic accompaniment apparatus as claimed in claim 1, wherein said chord data decision means includes fractional chord data decision means, which chooses a fractional chord, when said count of said tone pitches is two, based on said previous chord data and a difference between pitch names corresponding to the two tone pitches.

* * * * *